US008955932B2

(12) United States Patent
Yanaka et al.

(10) Patent No.: US 8,955,932 B2
(45) Date of Patent: Feb. 17, 2015

(54) IMAGE FORMING APPARATUS AND HEAD DRIVE CONTROL METHOD

(71) Applicants: Atsushi Yanaka, Saitama (JP); Takahiro Yoshida, Kanagawa (JP); Yuu Kimura, Kanagawa (JP)

(72) Inventors: Atsushi Yanaka, Saitama (JP); Takahiro Yoshida, Kanagawa (JP); Yuu Kimura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/207,437

(22) Filed: Mar. 12, 2014

(65) Prior Publication Data

US 2014/0285554 A1 Sep. 25, 2014

(30) Foreign Application Priority Data

Mar. 23, 2013 (JP) ..... 2013-061191

(51) Int. Cl.
*B41J 2/15* (2006.01)
*B41J 2/045* (2006.01)

(52) U.S. Cl.
CPC ..... *B41J 2/04588* (2013.01)
USPC ..... 347/10; 347/68

(58) Field of Classification Search
None
See application file for complete search history.

(56) References Cited

U.S. PATENT DOCUMENTS

| | | | | |
|---|---|---|---|---|
| 7,249,816 | B2 | 7/2007 | Kusunoki et al. | |
| 8,308,257 | B2 * | 11/2012 | Matsushita et al. | 347/10 |
| 8,459,768 | B2 * | 6/2013 | Hasenbein et al. | 347/11 |
| 8,814,300 | B2 * | 8/2014 | Shin et al. | 347/10 |
| 2009/0289975 | A1 | 11/2009 | Yoshida | |
| 2011/0096113 | A1 | 4/2011 | Yoshida | |
| 2013/0182025 | A1 | 7/2013 | Yanaka | |

FOREIGN PATENT DOCUMENTS

| | | |
|---|---|---|
| JP | 2003-094639 | 4/2003 |
| JP | 2008-149703 | 7/2008 |
| JP | 2010-179585 | 8/2010 |

* cited by examiner

*Primary Examiner* — Lamson Nguyen
(74) *Attorney, Agent, or Firm* — Duft Bornsen & Fettig LLP

(57) ABSTRACT

A head drive control unit generates and outputs a pulse formed of a first expansion waveform element to expand individual liquid chambers, a first contraction waveform element to contract the individual liquid chambers, a second expansion waveform element to expand the individual liquid chambers, and a second contraction waveform element to return the individual liquid chambers that have repeatedly expanded and contracted to an initial state. The first contraction waveform element serves as a waveform element that contracts the individual liquid chambers at a timing of resonance with a change in a pressure in the individual liquid chambers due to the first expansion waveform element. The second contraction waveform element serves as a waveform element that suppresses the change in the pressure in the individual liquid chambers.

4 Claims, 10 Drawing Sheets

IMAGE FORMING APPARATUS AND HEAD DRIVE CONTROL METHOD

CROSS-REFERENCE TO RELATED APPLICATIONS

The present application claims priority to and incorporates by reference the entire contents of Japanese Patent Application No. 2013-061191 filed in Japan on Mar. 23, 2013.

BACKGROUND OF THE INVENTION

1. Field of the Invention

The present invention relates to an image forming apparatus and a head drive control method.

2. Description of the Related Art

As one type of image forming apparatuses, such as printers, facsimile machines, copiers, plotters, or multifunction peripherals (MFP) having functions of these devices, an image forming apparatus employing a liquid-ejection recording method is known, such as an inkjet recording apparatus that uses, as a recording head, a liquid ejection head to eject droplets.

In the image forming apparatuses as described above, there is a known apparatus including a head drive control device that generates a drive waveform of multiple time-series drive pulses, selects a single or multiple drive pulses from the drive waveform according to the size of a droplet, and applies the selected pulses to a pressure generator.

Conventionally, there is a known apparatus that generates a pulse as a drive pulse for ejecting dummy droplets. Specifically, a pulse is generated such that a potential of a pull-in waveform element (expansion waveform element) is reduced from a reference potential by a certain voltage in order to expand a pressurized liquid chamber to pull in the meniscus of a liquid in the nozzle, and a predetermined hold state is maintained. Subsequently, a potential of a pressurizing waveform element (contraction waveform element) is increased by a certain voltage in order to contract the pressurized liquid chamber to eject a droplet, and a predetermined hold state is maintained. Thereafter, the potential of the pull-in waveform element (expansion waveform element) is reduced again in order to expand the pressurized liquid chamber to tear off a portion of the droplet being ejected and to return a remaining portion to the inside of the nozzle, and a predetermined hold state is maintained. Subsequently, the potential of the pressurizing waveform element (contraction waveform element) is increased to return the pressurized liquid chamber to the initial state (at this time, by setting the slope of the waveform element to be moderate, droplets are not ejected) (Japanese Patent Application Laid-open No. 2008-149703).

Incidentally, in the image forming apparatus employing the liquid ejection method, there is a need to reduce generation of mist due to droplet ejection and to enable high-frequency driving.

Therefore, it is desirable to reduce generation of mist due to droplet ejection and to enable high-frequency driving.

SUMMARY OF THE INVENTION

It is an object of the present invention to at least partially solve the problems in the conventional technology.

According to an aspect of the present invention, there is provided an image forming apparatus including: a liquid ejection head that includes: a plurality of nozzles for ejecting droplets; a plurality of individual liquid chambers communicating with the respective nozzles; and a pressure generating unit that generates a pressure to pressurize liquid in the individual liquid chambers; and a head drive control unit that generates a drive waveform including multiple pulses in chronological order, selects at least one of the pulses from the drive waveform according to a size of a droplet, and outputs the selected pulse to the pressure generating unit, wherein the head drive control unit generates and outputs a pulse formed of a first expansion waveform element to expand the individual liquid chambers, a first contraction waveform element to contract the individual liquid chambers, a second expansion waveform element to expand the individual liquid chambers, and a second contraction waveform element to return the individual liquid chambers that have repeatedly expanded and contracted to an initial state, the first contraction waveform element serves as a waveform element that contracts the individual liquid chambers at a timing of resonance with a change in a pressure in the individual liquid chambers due to the first expansion waveform element, and the second contraction waveform element serves as a waveform element that suppresses the change in the pressure in the individual liquid chambers.

According to another aspect of the present invention, there is provided a head drive control method for controlling drive of a liquid ejection head, the liquid ejection head including a plurality of nozzles for ejecting droplets, a plurality of individual liquid chambers communicating with the respective nozzles, and a pressure generating unit that generates a pressure to pressurize liquid in the individual liquid chambers, and the head drive control method including: generating a drive waveform including multiple pulses in chronological order; selecting at least one of the pulses from the drive waveform according to a size of a droplet; outputting the selected pulse to the pressure generating unit, wherein the generating includes generating and outputting a pulse formed of a first expansion waveform element to expand the individual liquid chambers, a first contraction waveform element to contract the individual liquid chambers, a second expansion waveform element to expand the individual liquid chambers, and a second contraction waveform element to return the individual liquid chambers that have repeatedly expanded and contracted to an initial state, the first contraction waveform element serves as a waveform element that contracts the individual liquid chambers at a timing of resonance with a change in a pressure on the individual liquid chambers due to the first expansion waveform element, and the second contraction waveform element serves as a waveform element that suppresses the change in the pressure on the individual liquid chambers.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
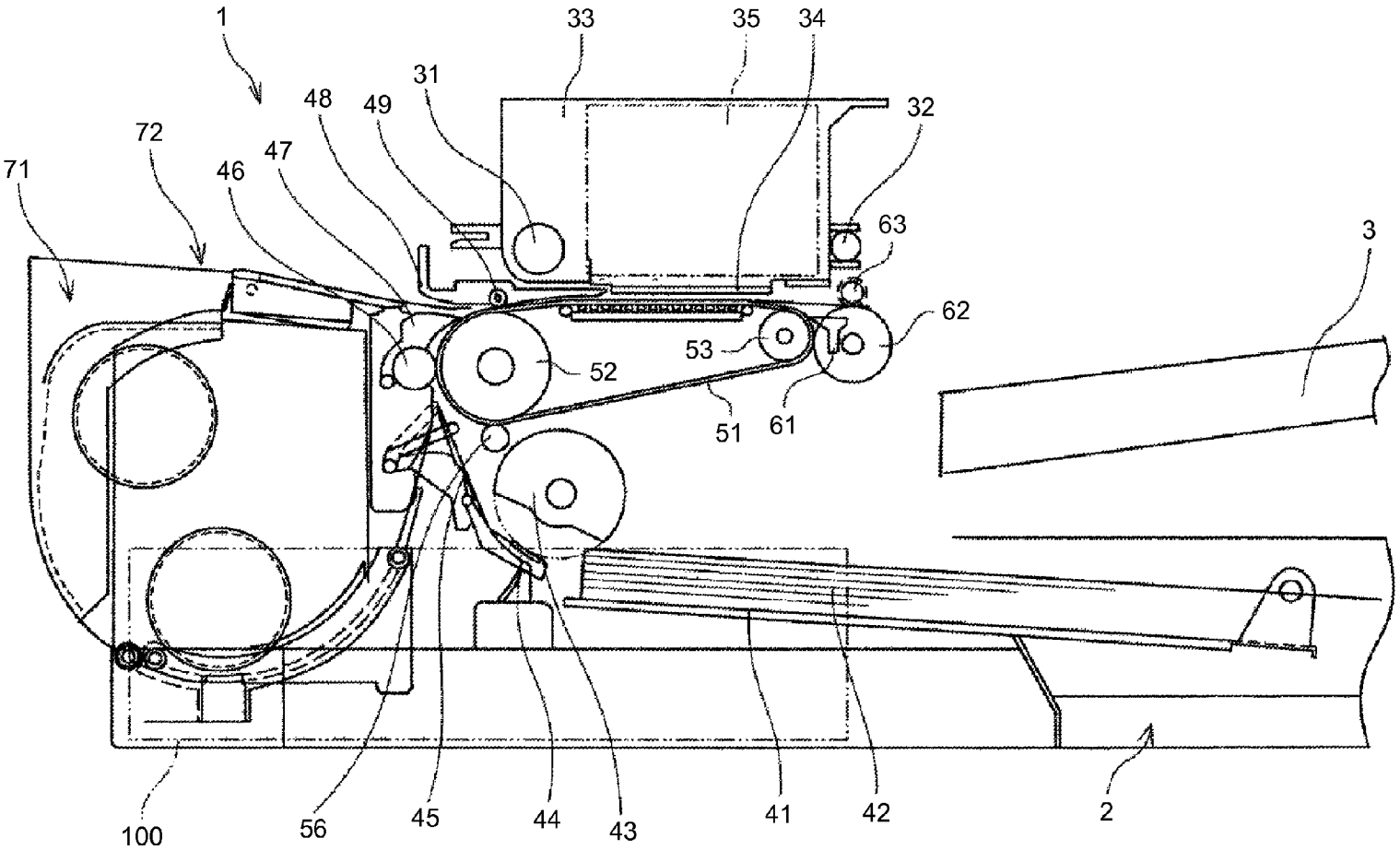
FIG. 1 is a side view for explaining a mechanical unit of an image forming apparatus according to an embodiment of the present invention.
Figure 2:
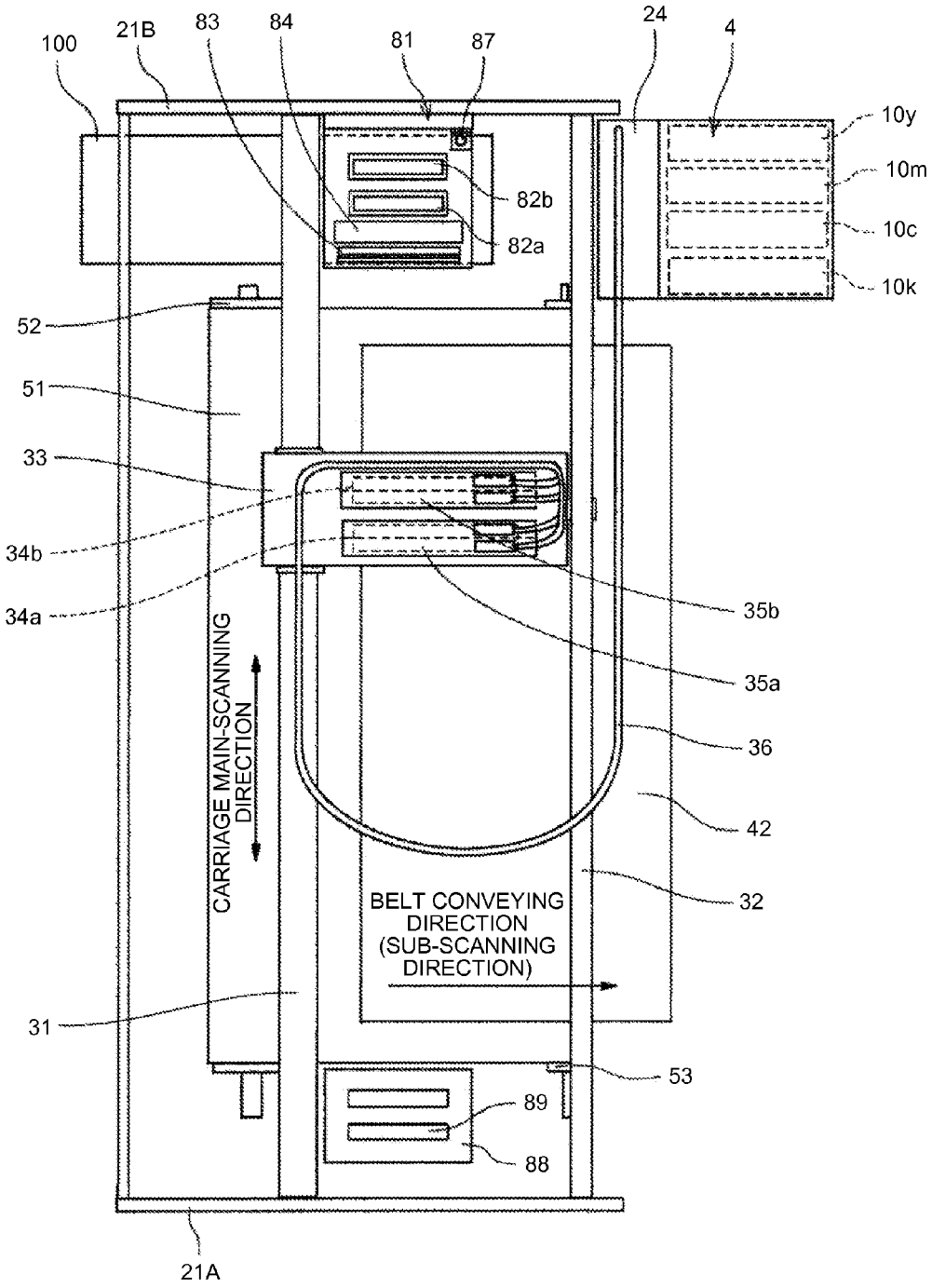
FIG. 2 is a plan view for explaining main components of the mechanical unit.

Exemplary embodiments of the present invention will be explained in detail below with reference to the accompanying drawings. An example of an image forming apparatus according to an embodiment of the present invention will be explained below with reference to FIG. 1 and FIG. 2. FIG. 1 is a side view for explaining a mechanical unit of the image forming apparatus. FIG. 2 is a plan view for explaining main components of the image forming apparatus.

The image forming apparatus is a serial-type inkjet recording apparatus. A carriage 33A is supported by main guide rod 31 and a sub guide rod 32, which serve as guiding members and which extend between a left-side plate 21A and a right-side plate 21B in an apparatus main body 1, such that the carriage 33 can slide in a main-scanning direction. The carriage 33 is moved in a direction of a double-headed arrow (carriage main-scanning direction) in FIG. 2 by a main-scanning motor (not illustrated) via a timing belt so as to perform scanning.

On the carriage 33, recording heads 34*a* and 34*b* (hereinafter, collectively referred to as "recording heads 34" when they are not distinguished, and the same applies to other components) are mounted that include liquid ejection heads for ejecting ink droplets of multiple colors of yellow (Y), cyan (C), magenta (M), and black (K). Each of the recording heads 34 is mounted such that a nozzle row formed of multiple nozzles is arranged in a sub-scanning direction perpendicular to the main-scanning direction and ink droplets are ejected in a downward direction.

Each of the recording heads 34 includes two nozzle rows. One of the nozzle rows mounted on the recording head 34*a* ejects droplets of black (K) liquid, and the other one of the nozzle rows ejects droplets of cyan (C) liquid. Furthermore, one of the nozzle rows mounted on the recording head 34*b* ejects droplets of magenta (M) liquid, and the other one of the nozzle rows ejects droplets of yellow (Y) liquid. Incidentally, a recording head in which multiple nozzle rows, each including multiple nozzles, for the respective colors are arranged on a single nozzle surface may be used as the recording heads 34.

On the carriage 33, head tanks 35*a* and 35*b* are also mounted that serve as a second ink supply unit to supply ink of corresponding colors to the respective nozzle rows of the recording heads 34. Meanwhile, ink cartridges (main tanks) 10*y*, 10*m*, 10*c*, and 10*k* for the respective colors are detachably attached to a cartridge mount section 4. A supply pump unit 24 supplies (replenishes) ink of the respective colors from the ink cartridges 10 to the head tanks 35 via supply tubes 36 provided for the respective colors.

The image forming apparatus further includes, as a feed unit to feed sheets 42 stacked on a sheet stack section (platen) 41 of a feed tray 2, a semicircular roller (feed roller) 43 that separates the sheets 42 on the sheet stack section 41 from one another and a separation pad 44 arranged opposite to the sheet feed roller 43. The separation pad 44 is biased toward the sheet feed roller 43.

To convey the sheet 42 fed from the sheet feed unit to a position below the recording heads 34, the image forming apparatus further includes a guide member 45 that guides the sheet 42, a counter roller 46, a conveying guide member 47, a pressing member 48 including a leading-end pressing roller 49. The image forming apparatus also includes a conveying belt 51 serving as a conveying means that conveys the fed sheet 42 to a position facing the recording heads 34 while causing the sheet 42 to be electrostatically attracted to the conveying belt 51.

The conveying belt 51 is an endless belt that is stretched between a conveying roller 52 and a tension roller 53 so as to circulate in a belt conveying direction (sub-scanning direction). A charging roller 56 serving as a charging means is provided to electrically charge the surface of the conveying belt 51. The charging roller 56 comes in contact with the surface of the conveying belt 51 and rotates with the rotational movement of the conveying belt 51. The conveying roller 52 is rotated by a sub-scanning motor (not illustrated), so that the conveying belt 51 circulates in the belt conveying direction in FIG. 2.

The image forming apparatus further includes, as a discharge unit to discharge the sheet 42 on which an image is recorded by the recording heads 34, a separation claw 61 that separates the sheet 42 from the conveying belt 51, a discharge roller 62, a spur 63 serving as a discharge roller, and a discharge tray 3 arranged below the discharge roller 62.

A duplex unit 71 is detachably attached to a back side of the apparatus main body 1. The duplex unit 71 receives the sheet 42 returned due to reverse rotation of the conveying belt 51, turns the sheet 42 upside down, and feeds the sheet 42 to a nip between the counter roller 46 and the conveying belt 51. The top surface of the duplex unit 71 serves as a manual-feed tray 72.

A maintenance/recovery mechanism 81 that maintains and recovers nozzle conditions of the recording heads 34 is arranged in a non-print area on one end in the main-scanning direction of the carriage 33. The maintenance/recovery mechanism 81 includes cap members 82*a* and 82*b* (hereinafter, collectively referred to as "caps 82" when they are not distinguished) to cover the nozzle surfaces of the recording heads 34. The maintenance/recovery mechanism 81 further includes a wiper member (wiper blade) 83 to wipe the nozzle surfaces, and a dummy droplet receptacle 84 to receive droplets when dummy ejection for ejecting droplets that do not contribute to recording is performed to discharge thickened recording liquid. The maintenance/recovery mechanism 81 further includes a carriage lock 87 to lock the carriage 33. A waste liquid tank 100 for storing waste liquid generated through maintenance/recovery operation performed on the heads by the maintenance/recovery mechanism 81 is attached to the apparatus main body in a replaceable manner.

Another dummy droplet receptacle 88 is arranged in a non-print area on the other end in the main-scanning direction of the carriage 33 to receive droplets when dummy ejection for ejecting droplets that do not contribute to recording is performed to discharge thickened recording liquid. The dummy droplet receptacle 88 has an opening 89 along the nozzle rows of the recording heads 34.

In the image forming apparatus configured as described above, the sheet 42 is separated from the other sheets 42 from the feed tray 2, fed in a substantially vertically-upward direction, guided by the guide member 45, and conveyed while being nipped between the conveying belt 51 and the counter roller 46. Furthermore, a leading end of the sheet 42 is guided by a conveying guide and pressed against the conveying belt 51 by the leading-end pressing roller 49, so that the conveying direction is turned by about 90°.

At this time, the charging roller 56 charges the conveying belt 51 with alternately-charged voltage patterns. When the sheet 42 is fed onto the charged conveying belt 51, the sheet 42 is attracted to the conveying belt 51 and conveyed in the sub-scanning direction with the rotational movement of the conveying belt 51.

Meanwhile, the recording heads 34 are driven in accordance with image signals while the carriage 33 is moving, so that ink droplets for recording one line are ejected on the sheet 42 being stopped. Subsequently, the sheet 42 is conveyed by a predetermined amount, and next recording is performed. A signal indicating completion of the recording or indicating that a trailing end of the sheet 42 has reached a recording area, the recording operation is finished and the sheet 42 is discharged to the discharge tray 3.

Figure 3:
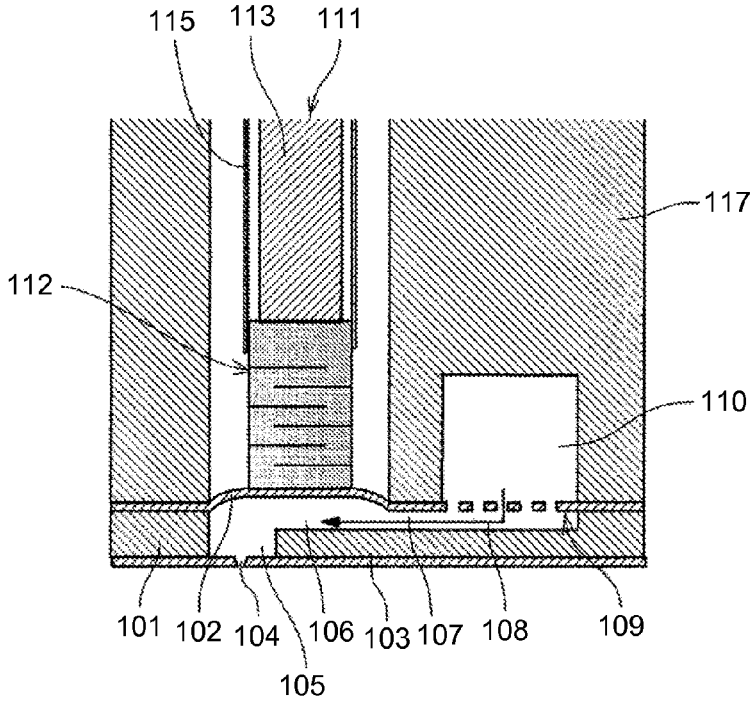
FIG. 3 is a cross-sectional view illustrating an example of a liquid ejection head included in a recording head of the image forming apparatus taken along the longitudinal direction of a liquid chamber.
Figure 4:
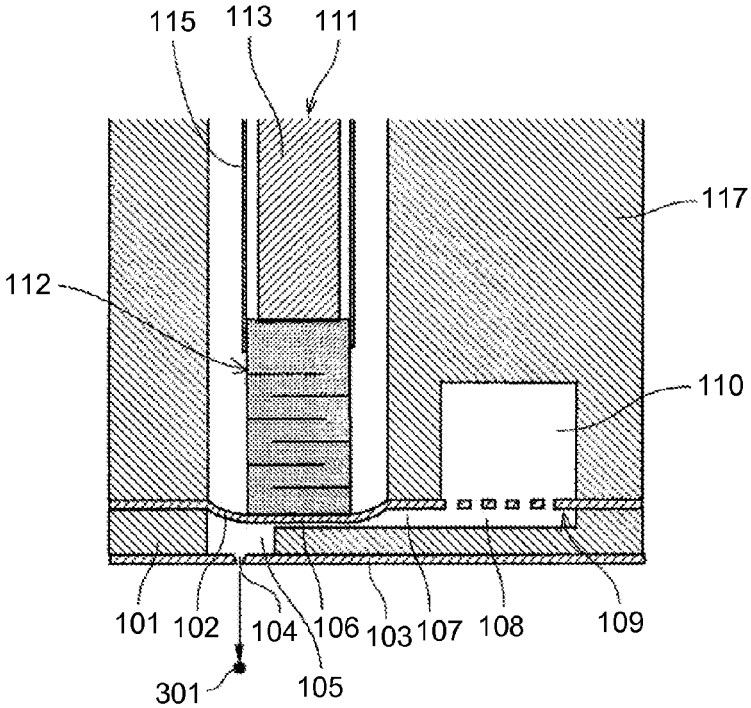
FIG. 4 is a cross-sectional view for explaining droplet ejection operation.

An example of liquid ejection heads forming the recording heads 34 will be explained below with reference to FIG. 3 and FIG. 4. FIG. 3 and FIG. 4 are cross-sectional views of a head taken along the longitudinal direction of a liquid chamber (a direction perpendicular to the nozzle row direction).

In the liquid ejection head, a channel plate 101, a diaphragm member 102, and a nozzle plate 103 are joined together. Therefore, an individual liquid chamber 106 that communicates with a nozzle 104 for ejecting droplets via a through hole 105, a fluid resistance portion 107 for supplying liquid to the individual liquid chamber 106, and a liquid introducing portion 108 are formed. Ink is introduced from a common chamber 110 formed on a frame member 117 to the liquid introducing portion 108 via a filter 109 formed on the diaphragm member 102, and then supplied from the liquid introducing portion 108 to the individual liquid chamber 106 via the fluid resistance portion 107. Incidentally, the "individual liquid chamber" includes what is called a pressurized chamber, a pressurized liquid chamber, a pressure chamber, an individual channel, a pressure generation chamber, and the like.

The channel plate 101 is formed by depositing metal plates, such as stainless steel (SUS) so as to form openings and grooves, such as the through hole 105, the individual liquid chamber 106, the fluid resistance portion 107, and the liquid introducing portion 108. The diaphragm member 102 is a wall member that forms wall surfaces of the individual liquid chamber 106, the fluid resistance portion 107, the liquid introducing portion 108, and the like. The diaphragm member 102 also forms the filter 109. The channel plate 101 may be formed by performing anisotropic etching on a silicon substrate, instead of using the metal plates, such as SUS.

A pillar-shaped laminated piezoelectric member 112, which serves as an actuator means (pressure generating means) that generates energy to apply pressure to ink in the individual liquid chamber 106 in order to eject droplets from the nozzle 104, is bonded on a surface of the diaphragm member 102 opposite to the individual liquid chamber 106. One end of the piezoelectric member 112 is joined to a base member 113, and a flexible printed circuit (FPC) 115 is connected to the piezoelectric member 112 to transmit drive waveforms. With the components as described above, a piezoelectric actuator 111 is formed.

While the d33 mode is employed in the embodiment in which the piezoelectric member 112 expands and contracts in the lamination direction, it may be possible to employ the d31 mode in which the piezoelectric member 112 expands and contracts in a direction perpendicular to the lamination direction.

In the liquid ejection head configured as described above, as illustrated in FIG. 3 for example, by reducing a voltage applied to the piezoelectric member 112 to be below a reference potential Ve, the piezoelectric member 112 contracts, so that the diaphragm member 102 is deformed and the volume of the individual liquid chamber 106 is expanded. Therefore, the ink flows into the individual liquid chamber 106.

Subsequently, as illustrated in FIG. 4, by increasing the voltage applied to the piezoelectric member 112, the piezoelectric member 112 extends in the lamination direction, so that the diaphragm member 102 is deformed toward the nozzle 104 and the volume of the individual liquid chamber 106 is contracted. Therefore, ink in the individual liquid chamber 106 is pressurized and a droplet 301 is ejected from the nozzle 104.

By returning the voltage applied to the piezoelectric member 112 to the reference potential Ve, the diaphragm member 102 is restored to an initial position, so that the individual liquid chamber 106 expands and a negative pressure is generated. Accordingly, ink is replenished from the common chamber 110 to the individual liquid chamber 106. After vibration of a meniscus surface of the nozzle 104 is attenuated to a stable state, the process proceeds to operation for ejecting next droplets.

Figure 5:
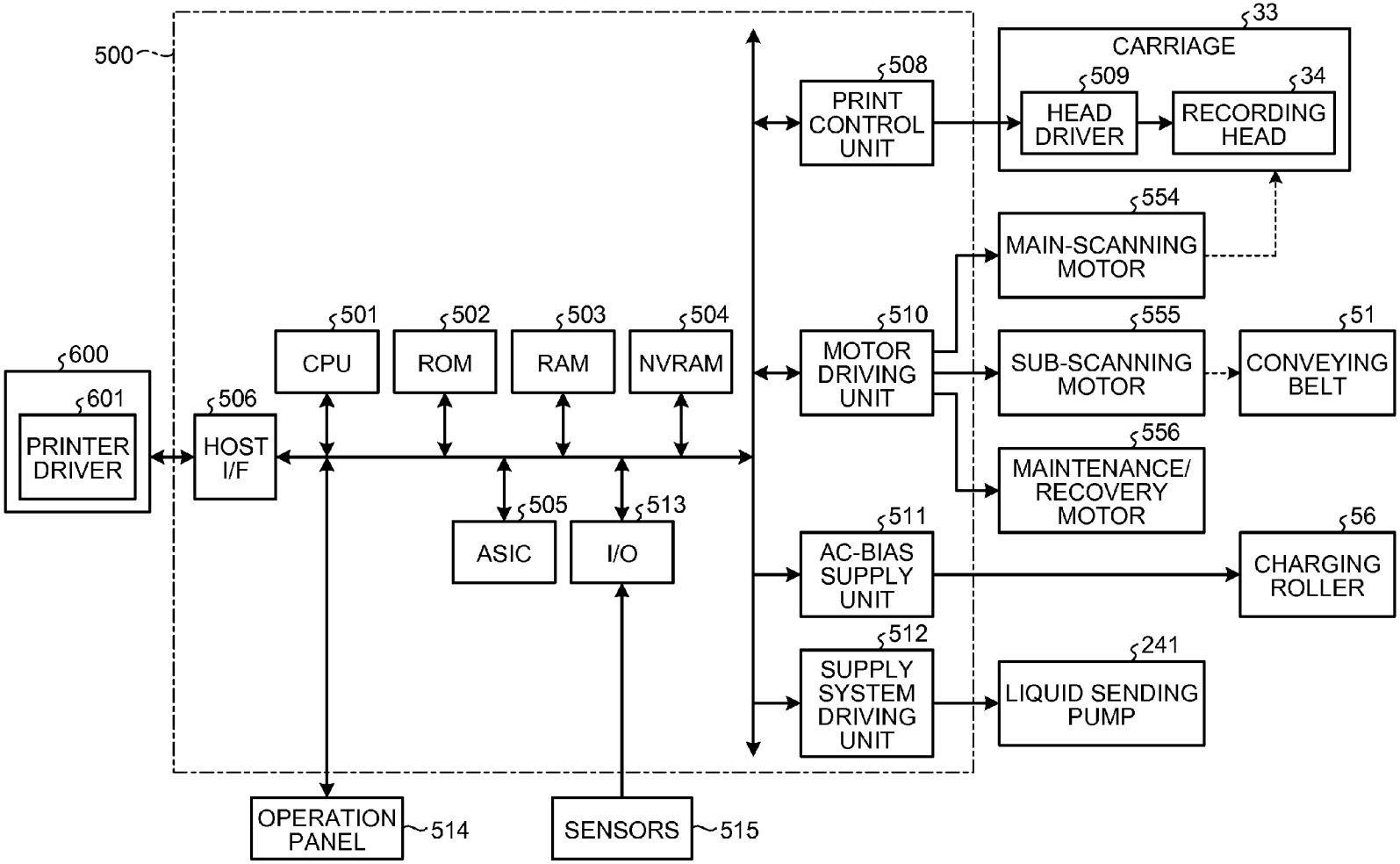
FIG. 5 is a block diagram illustrating a control unit of the image forming apparatus.

A control unit of the image forming apparatus will be explained below with reference to FIG. 5. FIG. 5 is a block diagram illustrating the control unit.

A control unit 500 includes a central processing unit (CPU) 501 that controls the entire apparatus, a read-only memory (ROM) 502 for storing fixed data, such as various programs executed by the CPU 501, and a random access memory (RAM) 503 for temporarily storing image data or the like. The control unit 500 also includes a nonvolatile memory 504 capable of rewriting data to maintain the data while the apparatus is powered off, and an application-specific integrated circuit (ASIC) 505 that performs various signal processing for image data, performs image processing including sorting or the like, and performs processing on input/output signals to control the entire apparatus.

The control unit 500 also includes a print control unit 508 including a data transfer means and a driving signal generating means to drive and control the recording heads 34, and a head driver (driver IC) 509 that is mounted on the carriage 33 to drive the recording heads 34. The control unit 500 also includes a main-scanning motor 554 that moves the carriage 33 to perform scanning, a sub-scanning motor 555 that causes the conveying belt 51 to circulate, and a motor driving unit 510 that drives a maintenance/recovery motor 556 to move the caps 82 and the wiper members 83 of the maintenance/recovery mechanism 81, or to drive a suction pump. The control unit 500 also includes an alternating current (AC)-bias supply unit 511 that supplies an AC bias to the charging roller 56, and a supply system driving unit 512 that drives a liquid sending pump 241.

The control unit 500 is connected to an operation panel 514 to input and display information needed for the image forming apparatus.

The control unit 500 includes an interface (I/F) 506 for transmitting and receiving data and signals from a host. The control unit 500 transmits and receives data and signals to and from a host 600, such as an information processing apparatus (e.g., a personal computer), an image reading device, or an imaging device, by using the I/F 506 via a cable or a network.

The CPU 501 of the control unit 500 reads and analyzes print data stored in a reception buffer of the I/F 506, causes the ASIC 505 to perform necessary image processing, data sorting, or the like, and transfers the image data from the print control unit 508 to the head driver 509. Incidentally, dot-pattern data for outputting images may be performed by a printer driver 601 of the host 600 or by the control unit 500.

The print control unit 508 transfers the above-described image data as serial data and outputs, to the head driver 509, transfer clocks, latch signals, controls signals, and the like needed to transfer the image data or to determine the transfer. The print control unit 508 also includes a digital-to-analog (D/A) converter that performs D/A conversion on drive-waveform pattern data stored in the ROM 502, and includes a voltage amplifier and a driving signal generating unit formed of a current amplifier or the like. The print control unit 508 generates a drive waveform of a single drive pulse or multiple drive pulses, and outputs the drive waveform to the head driver 509.

The head driver 509 selects drive pulses of a drive waveform given by the print control unit 508, based on serially-input image data corresponding to one line recorded by the recording heads 34, and applies the selected drive pulse to the piezoelectric member 112 serving as a pressure generating means of the recording heads 34. Therefore, the recording heads 34 are driven. At this time, it is possible to selectively eject dots of different sizes, such as large droplets, middle droplets, or small droplets, by selecting a part or all of the pulses forming the drive waveform or by selecting a part or all of waveform elements forming the pulses.

An input/output (I/O) unit 513 acquires information from various sensors 515 mounted on the image forming apparatus, extracts information needed to control a printer, and uses the information to control the print control unit 508, the motor driving unit 510, or the AC-bias supply unit 511. The sensors 515 include an optical sensor to detect the position of a sheet, a thermistor to monitor a temperature in the apparatus, a sensor to monitor the voltage of a charging belt, an interlock switch to detect opening and closing of a cover, and the like. The I/O unit 513 can process various types of information obtained from the sensors.

Figure 6:
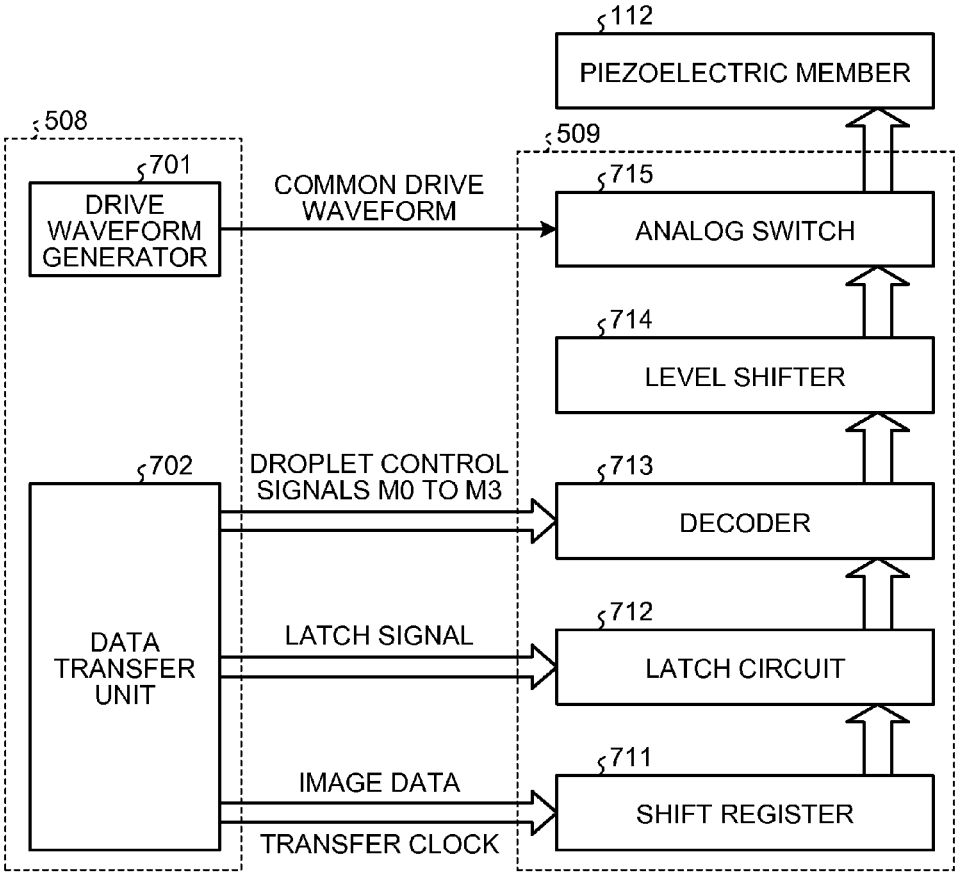
FIG. 6 is a block diagram illustrating an example of a print control unit and a head driver of the control unit.

An example of the print control unit 508 and the head driver 509 will be explained below with reference to a block diagram in FIG. 6.

The print control unit 508 includes a drive waveform generator 701 and a data transfer unit 702. The drive waveform generator 701 generates and outputs a waveform (common drive waveform) containing multiple pulses (driving signals) within a single print cycle (a single driving cycle) in image formation. The data transfer unit 702 outputs two-bit image data (gray-scale signals 0 and 1) corresponding to a printing image, clock signals, latch signals (LAT), and droplet control signals M0 to M3.

The droplet control signals are two-bit signals to give an instruction to open and close an analog switch 715, which serves as a switching means of the head driver 509 (to be described later), for each droplet. The droplet control signals change the state to a high (H) level (ON state) at a selected pulse or waveform element and to a low (L) level (OFF state) at a non-selected pulse or waveform element, in synchronization with the print cycle of the common drive waveform.

In the embodiment, a pulse for a large droplet is selected by the droplet control signal M3, a pulse for a middle droplet is selected by the droplet control signal M2, a pulse for a small droplet is selected by the droplet control signal M2, and a pulse for minute driving is selected by the droplet control signal M0.

The head driver 509 includes a shift register 711 that receives transfer clocks (shift clocks) and serial image data (gray-scale data; two bits/one channel, i.e., one nozzle) from the data transfer unit 702, and a latch circuit 712 that latches register values of the shift register 711 based on latch signals. The head driver 509 also includes a decoder 713 that decodes the gray-scale data and the droplet control signals M0 to M3 and outputs decoded results, and a level shifter 714 that shifts the level of logic-level voltage signals of the decoder 713 to a level at which the analog switch 715 is operable. The head driver 509 also includes the analog switch 715 that is turned on and off (opened and closed) according to the outputs of the decoder 713 sent via the level shifter 714.

The analog switch 715 is connected to selective electrodes (individual electrodes) of the piezoelectric member 112, and receives a common drive waveform Pv from the drive waveform generator 701. Therefore, the analog switch 715 is turned on according to results that the decoder 713 has obtained by decoding the serially-transferred image data (gray-scale data) and the droplet control signals M0 to M3. When the analog switch 715 is turned on, a desired pulse (or waveform element) of the common drive waveform Pv passes through (or is selected by) the analog switch 715 and is applied to the piezoelectric member 112.

Figure 7:
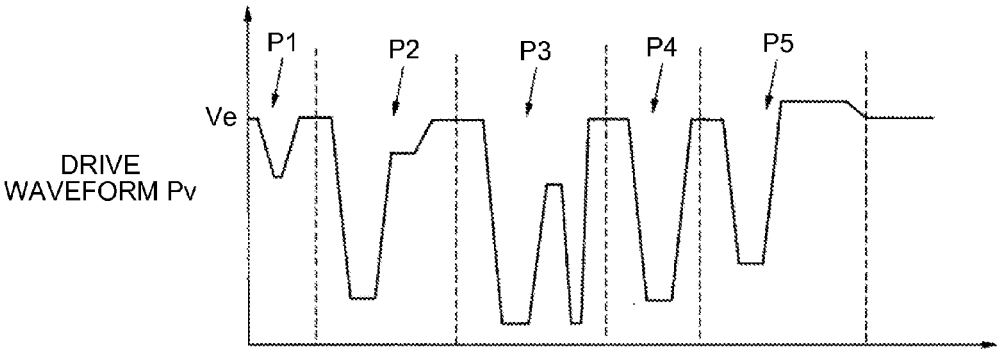
FIG. 7 is a diagram for explaining a drive waveform according to a first embodiment of the present invention.

A drive waveform according to the embodiment of the present invention will be explained below with reference to FIG. 7. FIG. 7 is a diagram for explaining the drive waveform.

Incidentally, a "pulse" indicates a drive pulse as an element forming a "drive waveform". An "ejection pulse" indicates a drive pulse that is applied to the pressure generating means to eject droplets. A "non-ejection pulse" indicates a drive pulse (minute drive pulse) that is applied to the pressure generating means to drive the pressure generating means to the extent that droplets are not ejected (to flow the ink in the nozzle). Furthermore, the drive waveform and the pulses as elements of the drive waveform are described by way of example only, and the present invention is not limited thereto.

The drive waveform (common drive waveform) Pv illustrated in FIG. 7 is a waveform formed by generating a drive pulse P1 serving as the minute drive pulse and drive pulses P2 to P5 serving as the ejection pulses in chronological order in a single print cycle (single driving cycle).

Figure 8:
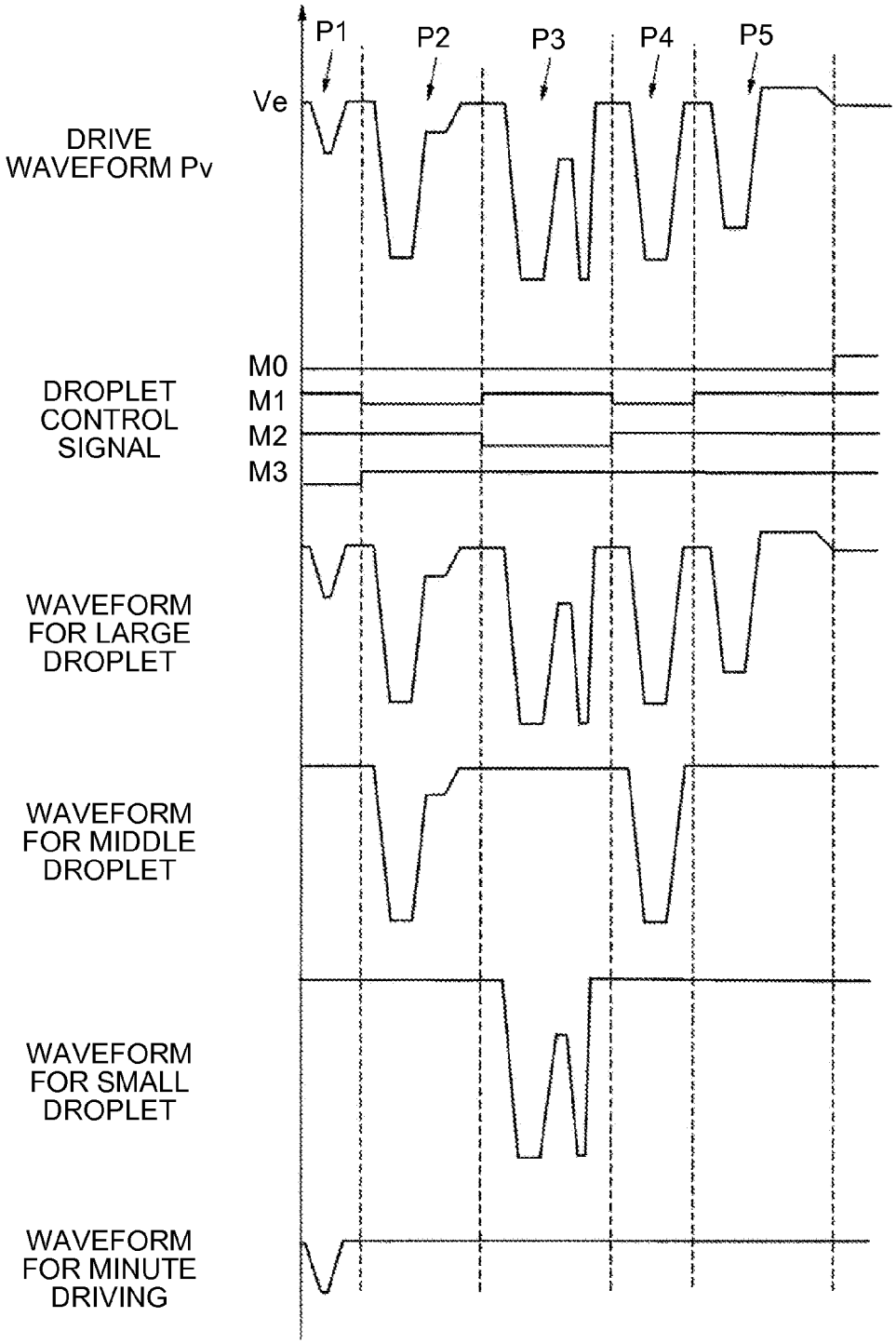
FIG. 8 is a diagram for explaining multiple drive waveforms generated from a drive waveform.

By selecting one or more of the pulses P1 to P5 according to the droplet control signals M3 to M0 as illustrated in FIG. 8, a single or multiple pulses are selected according to the size of a droplet, and a waveform to be applied to the pressure generating means is obtained, such as a drive waveform for ejecting large droplets, a drive waveform for ejecting middle droplets, a drive waveform for ejecting small droplets, or a drive waveform for minute driving as illustrated in FIG. 8.

Specifically, by selecting the pulses P1 to P5, the drive waveform for ejecting large droplets is obtained, so that droplets ejected at the pulses P2 to P5 fly and cohere to each other to form large droplets. By selecting the pulses P2 and P4, the drive waveform for ejecting middle droplets is obtained, so that droplets ejected at the pulses P2 and P4 fly and cohere to each other to form middle droplets. By selecting the pulse P3, the drive waveform for ejecting small droplets is obtained, so that small droplets are generated and ejected at the pulse P3. By selecting the pulse P1, the drive waveform for performing minute driving is obtained.

Figure 9:
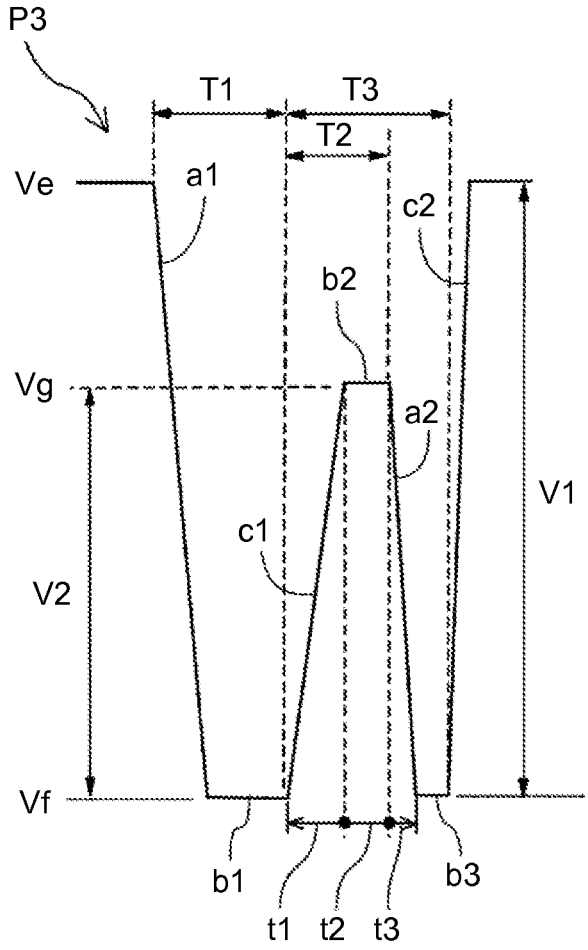
FIG. 9 is a diagram for explaining a concrete example of a pulse P3 used to form a small droplet.

The pulse P3 for generating small droplets will explained in detail below with reference to FIG. 9. FIG. 9 is a diagram for explaining a concrete example of the pulse P3.

The pulse P3 is generated and output by a head drive control means according to the embodiment, and includes a first expansion waveform element (first pull-in waveform element) a1, a retaining waveform element b1, a first contraction waveform element (first push-in waveform element) c1, a retaining waveform element b2, a second expansion waveform element (second pull-in waveform element) a2, a retaining waveform element b3, and a second contraction waveform element (second push-in waveform element) c2.

The first expansion waveform element a1 falls from the reference potential Ve to a potential Vf to expand the individual liquid chamber 106. The retaining waveform element b1 retains the potential Vf of the first expansion waveform element a1 for a predetermined time. The first contraction waveform element c1 rises from the potential Vf to a potential Vg (Vg<Ve) to contract the individual liquid chamber 106 to eject a droplet. The retaining waveform element b2 retains the potential Vg of the first contraction waveform element c1 for a predetermined time.

The second expansion waveform element a2 falls from the potential Vg to the potential Vf to expand the individual liquid chamber 106 to tear off a portion of the droplet being ejected at the first contraction waveform element c1 and return a remaining portion to the nozzle 104. The retaining waveform element b3 retains the potential Vf of the second expansion waveform element a2 for a predetermined time.

The second contraction waveform element c2 rises from the potential Vf to the reference potential Ve to contract the individual liquid chamber 106 to return the individual liquid chamber 106 that has repeatedly expanded and contracted to the initial state. At the second contraction waveform element c2, droplets are not ejected.

Incidentally, the first contraction waveform element c1 is a waveform element that contracts the individual liquid chamber 106 at a timing of resonance with a change in the pressure in the individual liquid chamber 106 due to the first expansion waveform element a1.

Furthermore, the second contraction waveform element c2 is a control waveform element that controls a change in the pressure in the individual liquid chamber 106 due to the first expansion waveform element a1, the first contraction waveform element c1, and the second expansion waveform element a2.

A droplet ejection state by application of the pulse P3 as described above will be explained below with reference to FIGS. 10A to 10D.

Figure 10:
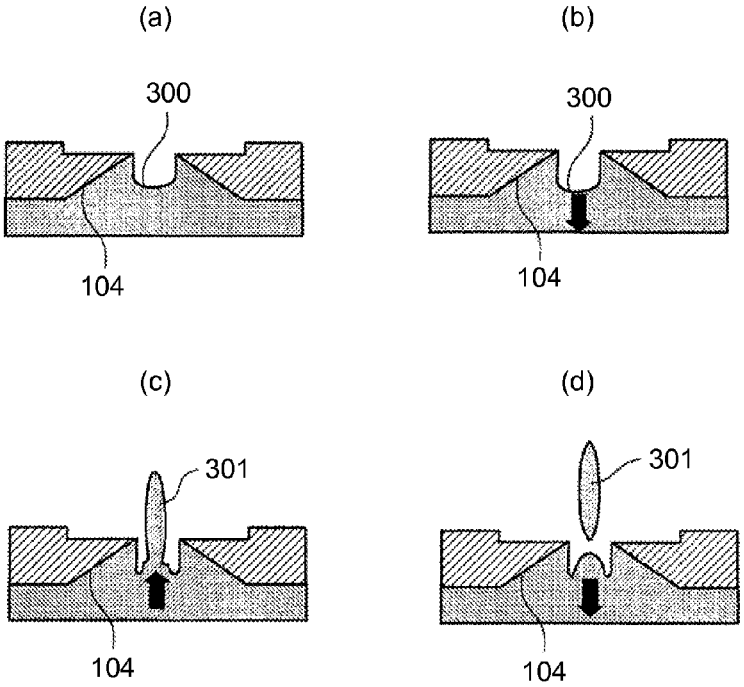
FIGS. 10(*a*) to 10(*d*) are diagrams for explaining a droplet ejection state when the pulse P3 is applied.

By applying the first expansion waveform element a1 in the state illustrated in FIG. 10A, a meniscus 300 is pulled into the nozzle 104 as illustrated in FIG. 10B. After a lapse of a predetermined time, by applying the first contraction waveform element c1, a portion to be the droplet 301 bulges as illustrated in FIG. 10C. At this time, by applying the second expansion waveform element a2, a portion of the droplet 301 is torn off and a remaining portion is returned to the nozzle 104 as illustrated in FIG. 10D.

Therefore, the droplet 301 becomes a small droplet. Furthermore, a tail portion of the droplet 301 that may become satellite or mist are torn off and returned to the nozzle 104, so that the satellite and the mist can be reduced.

Figure 11:
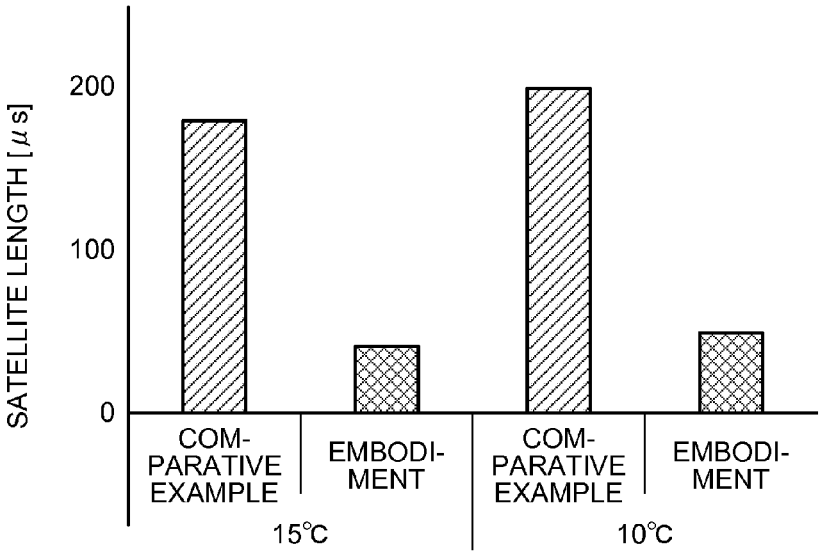
FIG. 11 is a diagram for explaining an example of a result of measurements of a satellite length with the pulse P3 and a pulse of a comparative example.

FIG. 11 illustrates a result of measurements of a satellite length when droplets are ejected by using the pulse P3 (embodiment) and a pulse for a small droplet in the same form as the pulse P2 (which is referred to as a "comparative example") at temperatures of 10° C. and 15° C.

As can be seen from FIG. 11, at both of the temperatures, the satellite length obtained with the pulse P3 of the embodiment becomes much shorter than the satellite length obtained with the pulse of the comparative example. By reducing the satellite length, it becomes possible to greatly reduce generation of mist due to satellite droplets separated from main droplets.

Figure 12:
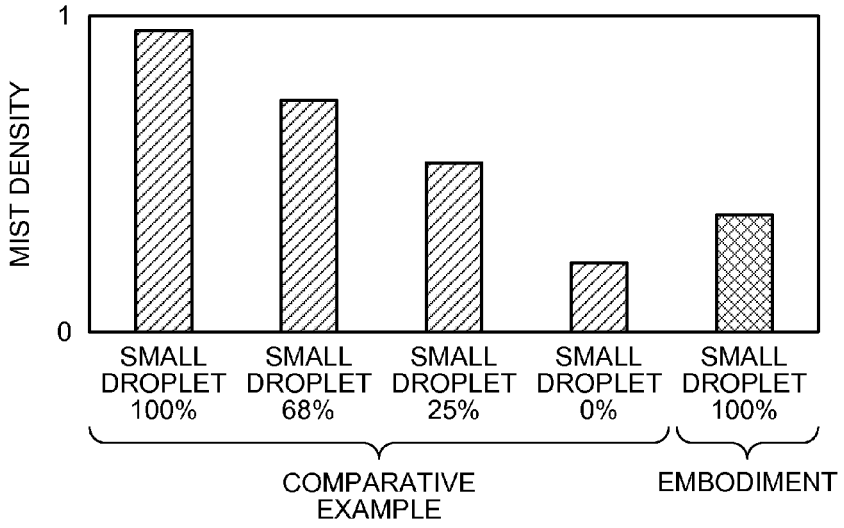
FIG. 12 is a diagram for explaining an example of a result of measurements of a mist density.

Furthermore, a mist density on a recorded medium was measured by using the pulse of the comparative example by changing (controlling) small-droplet use rates, in particular, with use of small droplets at different use rates of 100%, 68%, and 25% and with use of no small droplets (without small droplets), and by using the pulse P3 of the embodiment with a small-droplet use rate of 100%. FIG. 12 illustrates a result of the measurements.

As can be seen from FIG. 12, by using the pulse P3 of the embodiment, the mist density can be reduced to below the mist density obtained when the pulse of the comparative example was used with the reduced use rates, although the mist density with the pulse P3 has not reached the mist density obtained without small droplets. Namely, the mist can be reduced.

A relationship between reduction of mist and electrostatic conveyance will be explained below with reference to FIGS. 13A and 13B.

When images are formed by charging the conveying belt 51 and attracting the sheet 42 by an electrostatic attracting force in the image forming apparatus as described above, charges are formed on the surface of the sheet 42 at a charging pitch corresponding to the conveying belt 51.

Therefore, if the apparatus is filled with mist, because the mist itself is a charged microparticle, the mist is attracted to the charges on the surface of the sheet 42 applied by the conveying belt 51, so that a defective image, such as an image in which uneven charges are reflected, may be formed on the sheet 42.

Figure 13:
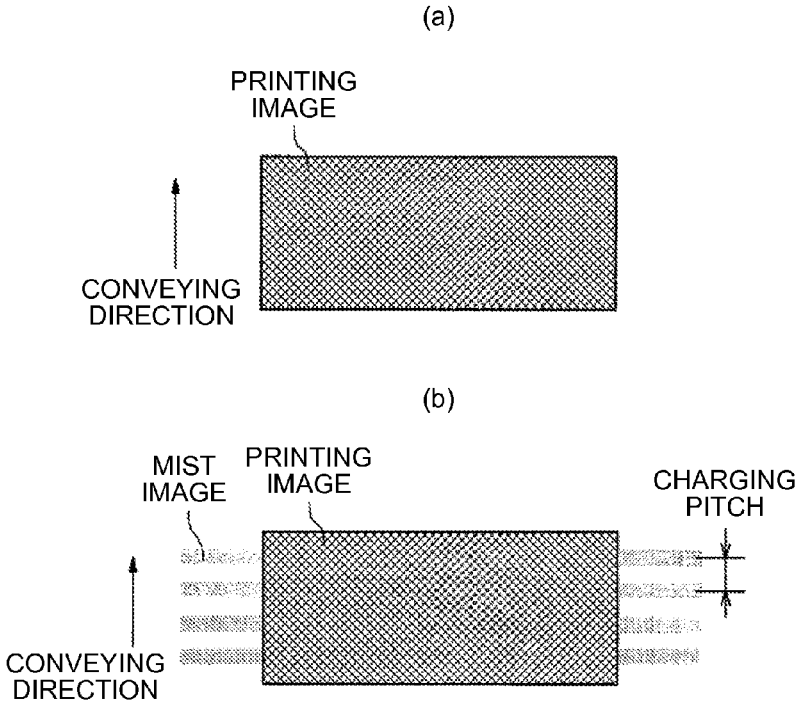
FIGS. 13(*a*) and 13(*b*) are diagrams for explaining a relationship between reduction of mist and electrostatic conveyance with the pulse P3.

Specifically, if the amount of mist increases, as illustrated in FIG. 13B, mist images corresponding to the charging pitch appears in a linear form in an image. In contrast, if the amount of mist is reduced, a mist image does not appear as illustrated in FIG. 13A.

It was confirmed that the mist image did not appear by using the pulse P3 of the embodiment, while the mist image appeared by using the pulse of the comparative example.

Operation and advantageous effects obtained when the second contraction waveform element c2 of the pulse P3 is used as the control waveform element will be explained below with reference to FIG. 14.

Figure 14:
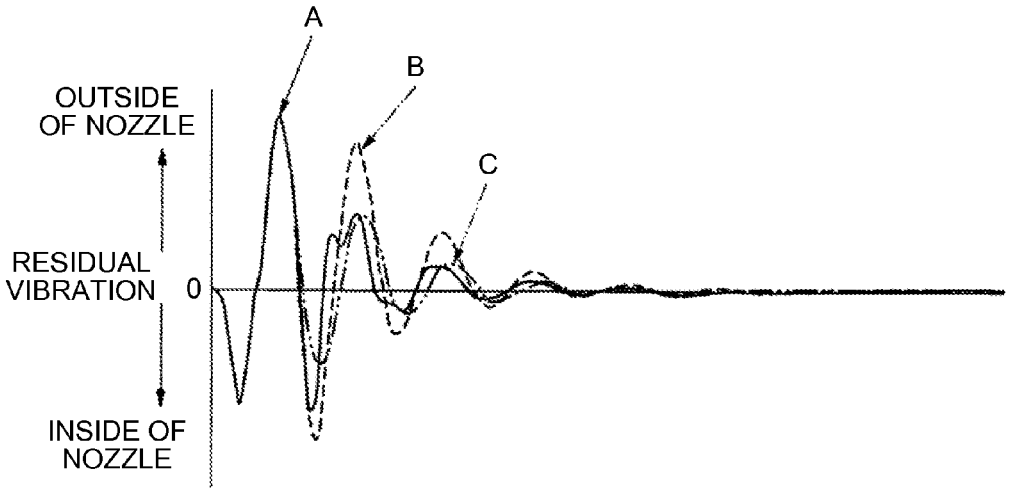
FIG. 14 is a diagram illustrating residual vibration for explaining operation and advantageous effects when a second contraction waveform element c2 of the pulse P3 is used as a control waveform element.

FIG. 14 illustrates residual vibration in the individual liquid chamber 106 after a droplet is ejected. In FIG. 14, a waveform A indicates residual vibration when a small droplet is ejected by using the pulse P3 of the embodiment. A waveform B indicates residual vibration when a small droplet is ejected by using a pulse in which the second contraction waveform element c2 of the pulse P3 of the embodiment is used as a waveform element other than the control waveform element. A waveform C indicates residual vibration when a small droplet is ejected under the condition that the first contraction waveform element c1 is returned to the reference potential and the droplet is not tore off at the second expansion waveform element a2 (a simple pull-push waveform).

As can be seen from FIG. 14, even when a droplet is tore off at the second expansion waveform element a2, if the second contraction waveform element c2 is not used as the control waveform element (the waveform B), it takes a longer time to attenuate the residual vibration compared with the case in which the second contraction waveform element c2 is used as the control waveform element (the waveform A). Furthermore, while the residual vibration in the waveform C attenuates faster than the residual vibration in the waveform B, the amount of mist increases with the waveform C.

As described above, by using the second contraction waveform element c2 of the pulse P3 as the control waveform element, it becomes possible to quickly reduce the residual vibration, enabling to perform high-frequency driving.

The potentials and voltage change rates of the waveform elements of the pulse P3 will be explained below with reference to FIG. 9.

In the embodiment, the voltage change rates of the first contraction waveform element c1 and the second expansion waveform element a2 of the pulse P3 are set to the same value. Assuming that a voltage change time of the first contraction waveform element c1 is denoted by t1, a voltage change time of the second expansion waveform element a2 is denoted by t3, and a retention time of the retaining waveform element b2 is denoted by t2, at least a relationship of t1>t3 is satisfied. Specifically, the rise time t1 of the first contraction waveform element c1 is set to be longer than the fall time t3 of the second expansion waveform element a2.

More specifically, while the rise time t1 of the first contraction waveform element c1 serves as a period in which a droplet is pushed outward from the nozzle, if the rise time t1 is reduced, crosstalk performance that is basic ejection performance is degraded, so that ejection performance is greatly influenced such that, for example, a drive waveform is corrupted.

Therefore, by adjusting the times t1 and t2, where t1 is the rise time taken to rise the first contraction waveform element c1 to the potential Vg and t2 is the retention time t2, it becomes possible to satisfy every requirement, such as to ensure an adequate droplet speed, an adequate droplet diameter, and stable high-frequency ejection with respect to target values, and to control satellite.

Specifically, in FIG. 9, assuming that a potential difference between the potential Ve and the potential Vf is denoted by V1 and a potential difference between the potential Vf and the potential Vg is denoted by V2, V1=14 volts (V) and V2=11 V. Furthermore, the times t1 to t3 are set such that t1=1 microseconds (μs), t2=1 μs, t3=0.5 μs.

A relationship of the start and the end of each of the waveform elements of the pulse P3 and a natural vibration cycle Tc will be explained below with reference to FIG. 9.

A time T1 from a start of the first expansion waveform element a1 to a start of the first contraction waveform element c1 is set to a range from 0.45 of Tc to 0.65 of Tc. Accordingly, a droplet ejection efficiency can be improved.

A time T2 from the start of the first contraction waveform element c1 to a start of the second expansion waveform element a2 (i.e., the time t2 as described above) is set to be shorter than 0.5 of Tc. Therefore, the satellite length can be shortened.

A time T3 from the start of the first contraction waveform element c1 to a start of the second contraction waveform element c2 is set to be 0.5 of Tc. Therefore, the second contraction waveform element c2 can serve as the control waveform element for controlling a change in the pressure in the individual liquid chamber 106 caused by the first expansion waveform element a1, the first contraction waveform element c1, and the second expansion waveform element a2.

Incidentally, the times T1 to T3 are not limited to those of the above examples. For example, it is sufficient that the time T3 is determined so that the individual liquid chamber 106 can be contracted by the second contraction waveform element a2 in the opposite phase with respect to a change in the pressure of the individual liquid chamber 106.

In the embodiment, a material of the "sheet" is not limited to paper and include an overhead projector (OHP) sheet, a cloth, a glass, a substrate, and the like. That is, the "sheet" indicates a material to which ink droplets or other liquid are attachable and includes what is called a recorded medium, a recording medium, a recording paper, a recording sheet, and the like. Furthermore, image formation, recording, print, imaging, and printing are used for the same meaning.

Moreover, the "image forming apparatus" is an apparatus that ejects liquid to a medium made of paper, yarn, fiber, fabric, leather, metal, plastic, glass, wood, ceramics, or the like to form images. The "image formation" includes not only formation of meaningful images, such as characters or graphics, but also meaningless images, such as patterns (for example, droplets are simply ejected onto the medium), on the medium.

Furthermore, the "ink" is not limited to what is called ink unless otherwise specified, and is used as a generic term including all types of liquid, such as what is called recording liquid, fixer liquid, or fluid, that enables image formation. For example, the "ink" includes DNA samples, resist, pattern materials, resin, and the like.

Moreover, the "image" is not limited to two-dimensional images, and includes images attached to three-dimensional objects and three-dimensional images of three-dimensional objects.

Furthermore, the image forming apparatus includes a serial-type image forming apparatus and a linear-type image forming apparatus unless otherwise specified.

According to the embodiment, it becomes possible to reduce generation of mist due to droplet ejection and to enable high-frequency driving.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a liquid ejection head that includes:

a plurality of nozzles for ejecting droplets;

a plurality of individual liquid chambers communicating with the respective nozzles; and a pressure generating unit that generates a pressure to pressurize liquid in the individual liquid chambers; and a head drive control unit that generates a drive waveform including multiple pulses in chronological order, selects at least one of the pulses from the drive waveform according to a size of a droplet, and outputs the selected pulse to the pressure generating unit, wherein the head drive control unit generates and outputs a pulse formed of a first expansion waveform element to expand the individual liquid chambers, a first contraction waveform element to contract the individual liquid chambers, a second expansion waveform element to expand the individual liquid chambers, and a second contraction waveform element to return the individual liquid chambers that have repeatedly expanded and contracted to an initial state, the first contraction waveform element serves as a waveform element that contracts the individual liquid chambers at a timing of resonance with a change in a pressure in the individual liquid chambers due to the first expansion waveform element, and the second contraction waveform element serves as a waveform element that suppresses the change in the pressure in the individual liquid chambers.

2. The image forming apparatus according to claim 1, wherein a time from a start of the first expansion waveform element to a start of the first contraction waveform element is in a range from 0.45 of a natural vibration cycle to 0.65 of the natural vibration cycle, a time from the start of the first contraction waveform element to a start of the second expansion waveform element is set to be shorter than 0.5 of the natural vibration cycle, and a time from the start of the first contraction waveform element to a start of the second contraction waveform element is set to be 0.5 of the natural vibration cycle.

3. The image forming apparatus according to claim 1, further comprising a conveying belt that conveys a recording medium on which an image is formed by the liquid ejection head, wherein the conveying belt attracts the recording medium by an electrostatic attracting force while conveying the recording medium.

4. A head drive control method for controlling drive of a liquid ejection head, the liquid ejection head comprising a plurality of nozzles for ejecting droplets, a plurality of individual liquid chambers communicating with the respective nozzles, and pressure generating unit that generates a pressure to pressurize liquid in the individual liquid chambers, and the head drive control method comprising:

generating a drive waveform including multiple pulses in chronological order;

selecting at least one of the pulses from the drive waveform according to a size of a droplet;

outputting the selected pulse to the pressure generating unit, wherein the generating includes generating and outputting a pulse formed of a first expansion waveform element to expand the individual liquid chambers, a first contraction waveform element to contract the individual liquid chambers, a second expansion waveform element to expand the individual liquid chambers, and a second contraction waveform element to return the individual liquid chambers that have repeatedly expanded and contracted to an initial state, the first contraction waveform element serves as a waveform element that contracts the individual liquid chambers at a timing of resonance with a change in a pressure on the individual liquid chambers due to the first expansion waveform element, and the second contraction waveform element serves as a waveform element that suppresses the change in the pressure on the individual liquid chambers.

* * * * *